US006776128B2

(12) United States Patent
Baba et al.

(10) Patent No.: US 6,776,128 B2
(45) Date of Patent: Aug. 17, 2004

(54) INTERNAL COMBUSTION ENGINE

(75) Inventors: Atsushi Baba, Wako (JP); Tatsuya Nakagawa, Wako (JP); Masahiko Minemi, Wako (JP); Tsuneo Endoh, Wako (JP); Taizou Kitamura, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/182,190

(22) PCT Filed: Jan. 25, 2001

(86) PCT No.: PCT/JP01/00492

§ 371 (c)(1),
(2), (4) Date: Nov. 14, 2002

(87) PCT Pub. No.: WO01/55576

PCT Pub. Date: Aug. 2, 2001

(65) Prior Publication Data

US 2003/0111026 A1 Jun. 19, 2003

(30) Foreign Application Priority Data

Jan. 26, 2000 (JP) ..... 2000-021816

(51) Int. Cl.[7] ..... F02F 1/36
(52) U.S. Cl. ..... 123/41.82 R
(58) Field of Search ..... 123/41.82 R, 193.5, 123/193.3, 41.69, 669, 668, 670, 41.44, 41.74, 41.34, 41.72

(56) References Cited

U.S. PATENT DOCUMENTS

| | | | | |
|---|---|---|---|---|
| 2,941,521 A | | 6/1960 | Rarey et al. | |
| 4,254,621 A | * | 3/1981 | Nagumo | 60/282 |
| 4,730,579 A | | 3/1988 | Yamada et al. | |
| 4,796,572 A | | 1/1989 | Heydrich | |
| 6,629,516 B1 | * | 10/2003 | Minemi et al. | 123/193.5 |

FOREIGN PATENT DOCUMENTS

| | | | | |
|---|---|---|---|---|
| JP | 52-056107 U | | 4/1977 | |
| JP | 62032264 A | * | 2/1987 | F02F/1/36 |
| JP | 10-212946 A | | 8/1998 | |

* cited by examiner

*Primary Examiner*—Tony M. Argenbright
*Assistant Examiner*—Hyder Ali
(74) *Attorney, Agent, or Firm*—Birch, Stewart, Kolasch & Birch, LLP

(57) ABSTRACT

In an internal combustion engine, a combustion chamber is provided in a cylinder head on one side of a partition wall, and a heat-insulating layer is provided in the cylinder head on the other side of the partition wall. Cooling passages are provided in a plurality of regions provided with different heat loads in the partition wall, respectively. The flow rate of a cooling medium is set, so that the flow rate in the cooling passage existing in the region of the larger heat load is larger than that in the cooling passage existing in the region of the smaller heat load. Thus, the temperature of an exhaust gas can be maintained at a high level by maintaining the combustion chamber at a high temperature.

12 Claims, 9 Drawing Sheets

INTERNAL COMBUSTION ENGINE

CROSS-REFERENCE TO RELATED APPLICATION

This application is the national phase under 35 U.S.C. §371 of PCT International Application No. PCT/JP01/00492 which has an International filing date of Jan. 25, 2001, which designated the United States of America.

BACKGROUND OF THE INVENTION

1. Field of the Invention

The present invention relates to an internal combustion engine and particularly, to an internal combustion engine constructed, so that the temperature of an exhaust gas produced in a combustion chamber can be maintained at a high level.

2. Description of the Background Art

In a conventional internal combustion engine, a combustion chamber is provided in a cylinder head on one side of a partition wall, and a cooling water passage is provided in the cylinder head on the other side of the partition wall (for example, see Japanese Patent Application Laid-open No.10-212946).

In order to utilize an exhaust gas as a heat source in a Rankine cycle system and to promote the warming and achieve the early activation of an exhaust gas purification system and the like, it is desirable that the temperature of the exhaust gas produced in the combustion chamber be maintained at as much a high level as possible.

In the conventional example, however, the following problem is encountered: The entire combustion chamber is cooled in such a manner that the extent of cooling of the partition wall is matched to a region where the heat load is the largest. Therefore, a region where the heat load is smaller is cooled to an excessive extent, and the entire combustion chamber tends to be overcooled. As a result, the temperature of the exhaust gas is lower and hence, it is impossible to meet the above-described modes sufficiently.

SUMMARY AND OBJECTS OF THE INVENTION

It is an object of the present invention to provide an internal combustion engine of the above-described type, wherein the temperature of the exhaust gas can be maintained at a high level by maintaining the combustion chamber at a high temperature.

To achieve the above object, according to the present invention, there is provided an internal combustion engine comprising a combustion chamber provided in a cylinder head on one side of a partition wall, a heat-insulating layer provided in the cylinder head on the other side of the partition wall, and cooling passages provided in a plurality of regions provided with different heat loads in the partition wall, respectively, so that the flow rate of a cooling medium is decreased from the cooling passage existing in the region of the largest heat load to the cooling passage existing in the region of the smallest heat load.

With the above arrangement, the plurality of regions of the different heat loads in the partition wall can be cooled to a necessary and minimum extent depending on the magnitudes of the heat loads. In addition, it is possible to suppress the propagation of heat to a main body of the cylinder head leading to the partition wall by the heat-insulating layer, thereby maintaining the combustion chamber at a high temperature to maintain the temperature of an exhaust gas at a high level.

According to the present invention, there is also provided an internal combustion engine, wherein the occupation rate of the region of the smaller heat load in the partition wall and the occupation rate of the region of the heat load larger than that of such region in the partition wall are such that the former is larger than the latter; the sectional area of the cooling passage existing in the region of the smaller heat load and the sectional area of the cooling passage existing in the region of the heat load larger than that of such region are such that the former is smaller than the latter; and the surface area of the cooling passage existing in the region of the smaller heat load and the surface area of the cooling passage existing in the region of the heat load larger than that of such region are such that the former is larger than the latter.

With the above arrangement, the function of the region of the larger heat load can be maintained by cooling such region depending on the heat load. On the other hand, the wide regions can be cooled effectively and uniformly to a necessary and minimum extend by a small amount of the cooling medium, while enhancing the heat abatement, by a synergistic effect provided by permitting the flowing of the cooling medium at a higher speed in the region of the smaller heat load and by an enhancement in heat transfer coefficient attributable to an increase in passage surface area and an increase in Reynolds number.

According to the present invention, it is possible to provide an internal combustion engine, wherein the combustion chamber is maintained at a high temperature to maintain the temperature of an exhaust gas at a high level, whereby the internal combustion engine is suitable as a component for a heat source for a Rankine cycle, and it is possible to promote the warming and to achieve the early activation of an exhaust gas purification system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
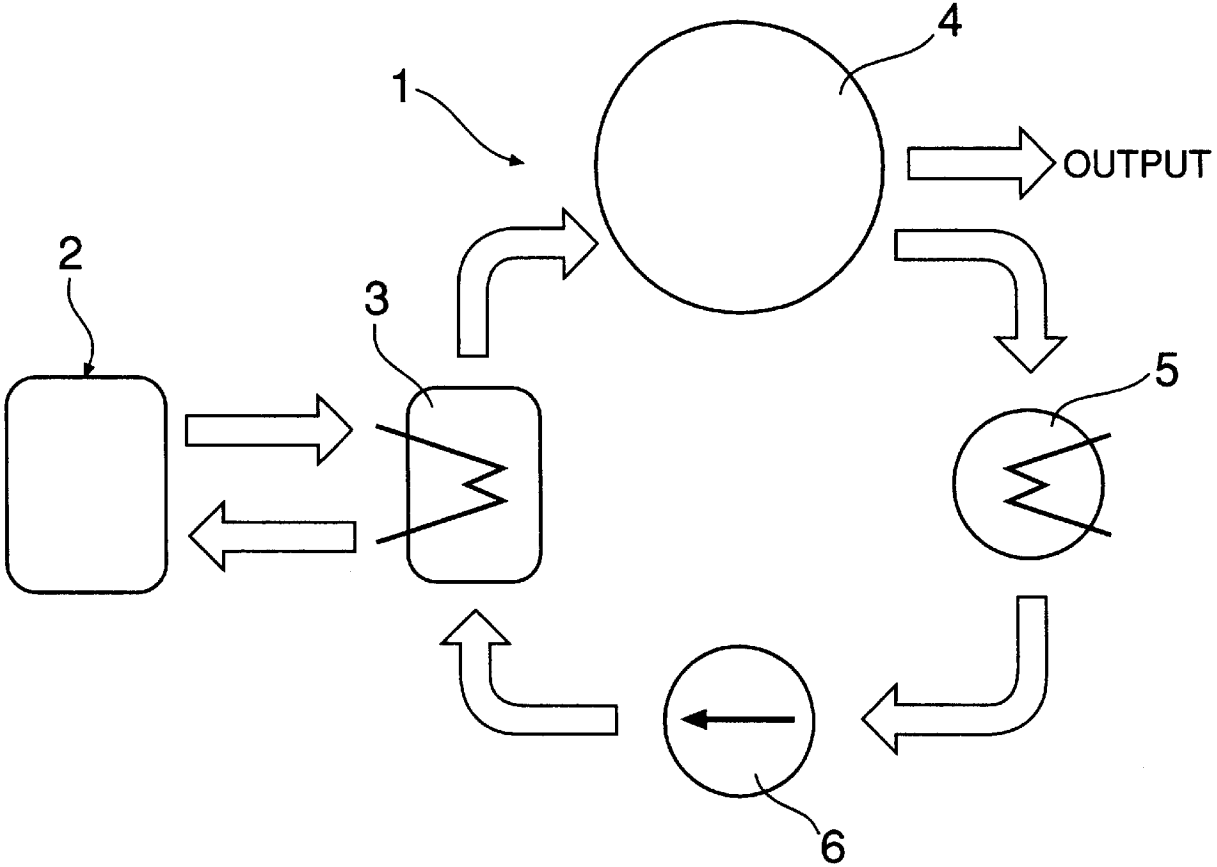
FIG. 1 is an illustration for explaining a Rankine cycle system.

Referring to FIG. 1, a Rankine cycle system 1 includes an evaporator 3 for generating a high-pressure vapor having a raised temperature, namely, a high-temperature and high-pressure vapor, from a high-pressure liquid, e.g., water, using an exhaust gas from an internal combustion engine 2 as a heat source, an expander 4 for generating an output by the expansion of the high-temperature and high-pressure vapor, a condenser 5 for liquefying the vapor discharged from the expander 4 and dropped in temperature and pressure after being expanded, namely, a dropped-temperature and dropped-pressure vapor, and a feed pump 6 for supplying water from the condenser 5 to the evaporator 3 under a pressure.

Figure 2:
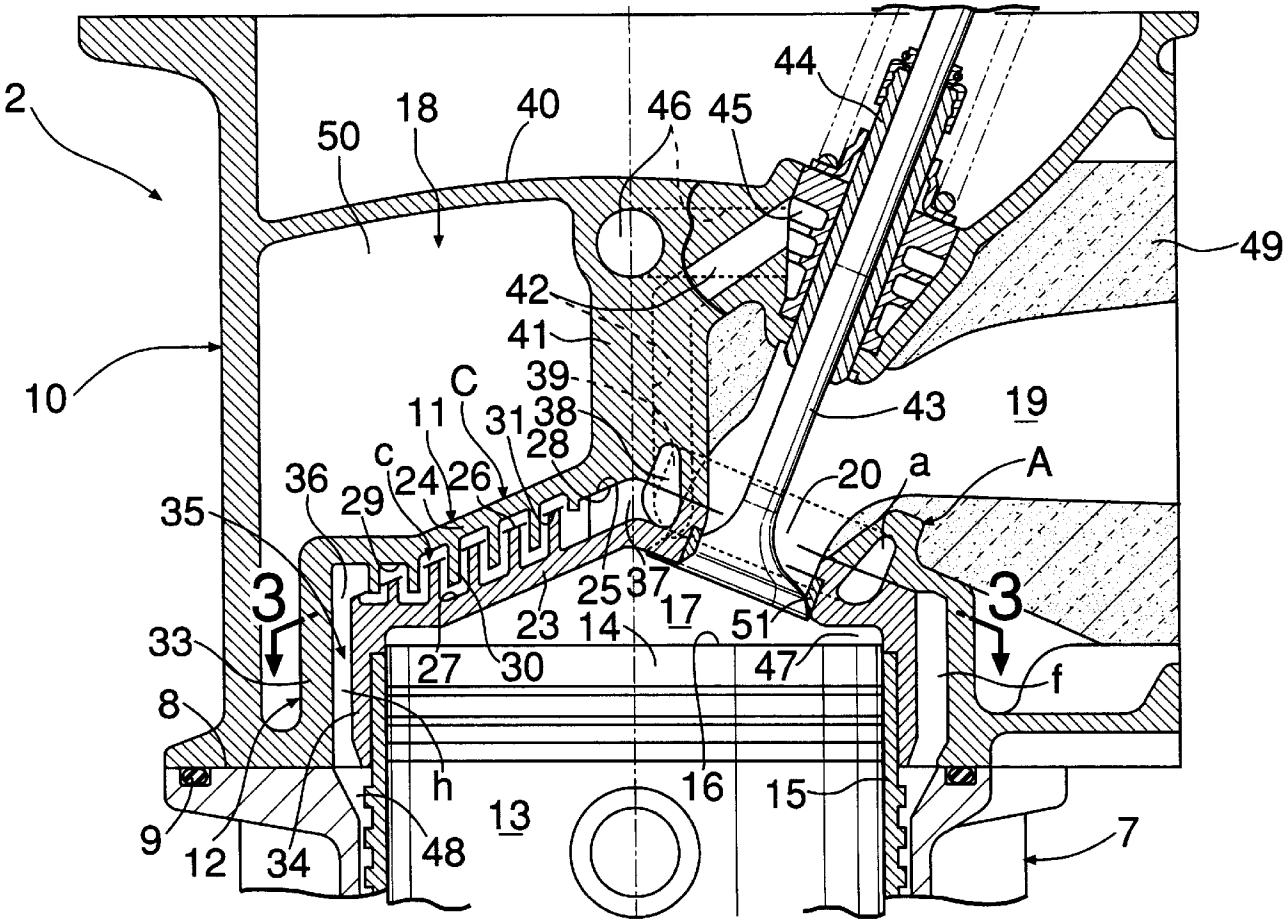
FIG. 2 is a vertical sectional front view showing a first example of a cylinder head, and corresponds to a sectional view taken along a line 2—2 in FIG. 3.
Figure 3:
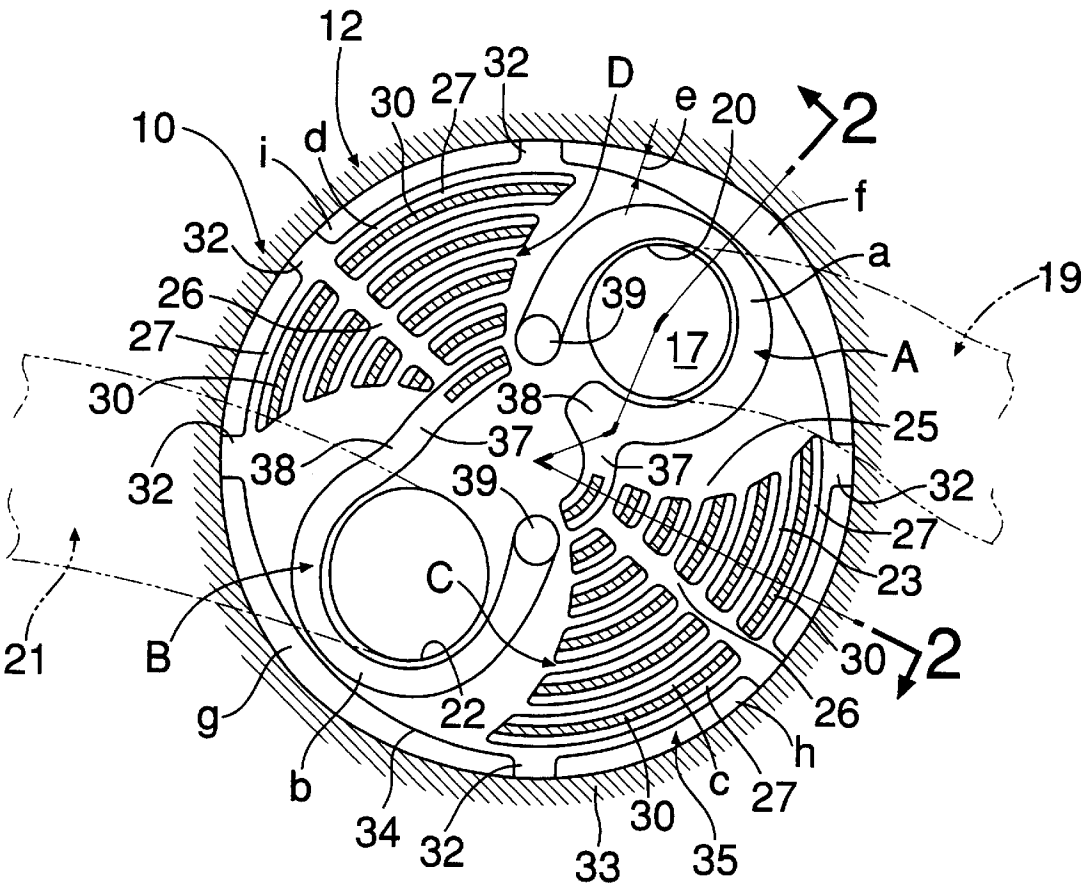
FIG. 3 is a sectional view taken along a line 3—3 in FIG. 2.

In a first embodiment of the internal combustion engine 2 shown in FIGS. 2 and 3, a cylinder head 10 is mounted to a deck surface 8 of a cylinder block 7 with a seal member 9 interposed therebetween. Provided in the cylinder head 10 are a partition wall 11 having a substantially conical shape with its apex turned in a direction opposite from the cylinder block 7, and a cylindrical peripheral wall 12 leading to a circular peripheral edge of the partition wall 11. A head 14 of a piston 13 lying at a top dead center is in sliding contact with an inner peripheral surface of the peripheral wall 12. In the embodiment, an end of a cylinder sleeve 15 protrudes from the deck surface 8 of the cylinder block 7 and is fitted to the inner peripheral surface of the peripheral wall 12, and the head 14 of the piston 13 is in sliding contact with the inner peripheral surface of the end of the cylinder sleeve 15. A substantially conical combustion chamber 17 is provided on one side of the partition wall 11 and defined by cooperation of the partition wall 11 and a top surface 16 of the head of the piston 13 lying at the top dead center, and a heat-insulating layer 18 is provided on the other side of the partition wall 11.

A plurality of sites having different heat loads exist in the partition wall 11. In the embodiment, these sites are an exhaust annular region A existing around an inlet 20 of an exhaust port 19, an intake annular region B existing around an outlet 22 of an intake port 21, an exhaust fan-shaped region C which exists on one side between the inlet 20 and the outlet 22 and extends in a divergent manner from a center portion of the partition wall 11 and is closer to the exhaust port 19, and an intake fan-shaped region D which exists on the other side between the inlet 20 and the outlet 22, extends in a divergent manner from the center portion of the partition wall 11 and is closer to the intake port 21.

In this case, the order of the magnitudes of the heat loads is such that the magnitude in the exhaust annular region A>the magnitude in the intake annular region B≧the magnitude in the exhaust fan-shaped region C≅the magnitude in the intake fan-shaped region D.

Cooling passages are provided in the regions A to D, respectively. The cooling passages are an exhaust curved passage a in the exhaust annular region A; an intake curved passage b in the intake annular region B; an exhaust fan-shaped passage c in the exhaust fan-shaped region C; and an intake fan-shaped passage d in the intake fan-shaped region D. In the embodiment, water is used as a cooling medium, but any cooling medium such as oil or the like may be selected.

The magnitudes of flow rates of the cooling water are set depending on the magnitudes of the heat loads, so that a flow rate in the exhaust curved passage a>a flow rate in the intake curved passage b≧a flow rate in the exhaust fan-shaped passage c≅a flow rate in the intake fan-shaped passage d.

In the cylinder head 10, the partition wall 11 is formed by mating together an inner wall 23 adjacent the combustion chamber 17 and an outer wall 24 adjacent the heat-insulating layer 18, and the exhaust curved passage a, the intake curved passage b, the exhaust fan-shaped passage c and the intake fan-shaped passage d are defined between the inner and outer walls 23 and 24.

The structure of the exhaust fan-shaped passage c is as follows: A dividing section 26 exists in a fan-shaped area on a mating surface 25 of the inner wall 23 to bisect the fan-shaped portion circumferentially, and a plurality of arcuate grooves 27 are concentrically defined on opposite sides of the dividing section 26. On the other hand, in a fan-shaped area on a mating surface 28 of the outer wall 24, there are a fan-shaped recess 29 which covers all the arcuate grooves 27 in the inner wall 23 and whose outer peripheral portion reaches the peripheral wall 12, when the outer wall 24 has been mated with the inner wall 23, a plurality of arcuate projections 30 protruding from the recess 29 and loosely inserted into the corresponding arcuate grooves 26, and a dividing section 31 superposed on the dividing section 26 in the inner wall 23. Thus, the exhaust fan-shaped passage c extends in a zigzag line in a plane parallel to a direction of the thickness thereof within the partition wall 11.

The outer peripheral portion of the fan-shaped recess 29 in the outer wall 24 communicates with a cylindrical cooling passage 35 defined between an outer peripheral wall 33 and an inner peripheral wall 34 in the peripheral wall 12, whereby an arcuate inlet 36 of the exhaust fan-shaped passage c is defined. Therefore, in the exhaust fan-shaped passage c, the flow rate is increased from the inlet 36 toward an outlet 37 existing at a center portion of the exhaust fan-shaped passage c. In FIG. 3, reference character 32 designates projection-shaped spacers formed at a plurality of points on the outer peripheral surface of the inner peripheral wall 34 to define the cylindrical cooling passage 35.

The outlet 37 of the exhaust fan-shaped passage c communicates with an inlet 38 of the exhaust curved passage a, and an outlet 39 of the exhaust curved passage a communicates with a passage 42 defined in a reinforcing rib 41 which connects the partition wall 11 and a wall 40 for defining the heat-insulating layer 18 to each other. The passage 42 communicates with a cooling passage 45 in a valve stem guide 44 in an exhaust valve 43, and the cooling passage 45 communicates with an outlet passage 46.

The intake fan-shaped passage d and the intake curved passage b are formed in substantially the same manner as the exhaust fan-shaped passage c and the exhaust curved passage a, respectively. In FIG. 3, components for the intake fan-shaped passage d and the intake curved passage b are designated by the same reference characters as those designating components for the exhaust fan-shaped passage c and the exhaust curved passage a, and the description of the passages d and b is omitted. A total flow rate of the cooling water in the exhaust curved passage a and the exhaust fan-shaped passage c and a total flow rate of the cooling water in the intake curved passage b and the intake fan-shaped passage d are set, so that the former is larger than the latter.

An occupation rate of the exhaust fan-shaped region C of the smaller heat load in the partition wall 11 and an occupation rate of the exhaust annular region A of the heat load larger than that of the region C in the partition wall 11 are such that the former C is larger than the latter A. Therefore, sectional areas of the exhaust fan-shaped passage c existing in the exhaust fan-shaped region C of the smaller heat load and the exhaust curved passage a existing in the exhaust annular region A of the larger heat load are set, so that the former C is smaller than the latter A, and surface areas of them are set, so that the former C is larger than the latter A.

An occupation rate of the intake fan-shaped region D of the smaller heat load in the partition wall 11 and an occupation rate of the intake annular region B of the heat load larger than that of the region D in the partition wall 11 are such that the former D is larger than the latter B. Therefore, sectional areas of the intake fan-shaped passage d existing in the intake fan-shaped region D of the smaller heat load and the intake curved passage b existing in the intake annular region B of the larger heat load are set, so that the former d is smaller than the latter b, and surface areas of them are set, so that the former d is larger than the latter b.

The cylindrical cooling passage 35 existing in the peripheral wall 12 cools a squish area 47 of the combustion chamber 17 defined by an outer peripheral portion of the head top surface 16 on the piston 13 lying at the top dead center. The squish area 47 is liable to become a heat stagnation. The flow rate of the cooling water in the cylindrical cooling passage 35 is set, so that it is decreased from a flow path section lying in the vicinity of a site in the squish area 47 where the heat load is the largest to a flow path section lying in the vicinity of a site in the squish area 47 where the heat load is the smallest. As shown in FIG. 3, in the embodiment, the magnitude of the flow rate of the cooling water in the cylindrical cooling passage 35 is such that the flow rate in a flow path section f lying in the vicinity of the exhaust port inlet 20>the flow rate in a flow path section g lying in the vicinity of the intake port outlet 22≧the flow rate in a flow path section h lying in the vicinity of the exhaust fan-shaped region C≧the flow rate in a flow path section i lying in the vicinity of the intake fan-shaped region D, by varying the passage width e depending on the magnitude of the heat load as shown in FIG. 3. The cylindrical cooling passage 35 communicates with a water jacket 48 in the cylinder block 7.

The heat-insulating layer 18 is defined by an exhaust port liner 49 formed in a cast-in manner from a ceramics in the cylinder head 10 in an area around the exhaust port 19, and also defined in the same manner in an area around the intake port 21 as in the area around the exhaust port 19 (the illustration is omitted). A section outside the heat-insulating layer 18 is formed by air existing in a cavity 50, but a heat-insulating material, e.g., a powdery heat-insulating material comprising particles having an nm size may be filled in the cavity 50.

In the above-described arrangement, the cooling water from the water jacket 48 flows through the cylindrical cooling passage 35 to cool the squish area 47 of the combustion chamber 17 to a necessary and minimum extent depending on the magnitude of the heat load from the periphery of the squish area 47. Then, the cooling water flows through the exhaust fan-shaped passage c and the intake fan-shaped passage d. In this case, because each of the sectional areas of the passages c and d are set at the smaller value, and each of the surface areas of the passages c and d are set at the larger value, the wider exhaust and intake fan-shaped regions C and D can be cooled effectively and uniformly to a necessary and minimum extend by a small amount of the cooling water, while enhancing the heat abatement, by a synergistic effect provided by permitting the flowing of the cooling water at a higher speed and by an enhancement in heat transfer coefficient attributable to an increase in passage surface area and an increase in Reynolds number.

Thereafter, the cooling water enters into the exhaust curved passage a from the exhaust fan-shaped passage c and flows through the exhaust curved passage a. In this case, because the exhaust fan-shaped passage c is convergent from the inlet 36 toward the outlet 37, the flow rate of the cooling water is increased in the outlet 37, and the cooling water of the increased flow rate flows through the exhaust curved passage a. Therefore, the exhaust annular region A where the heat load is the largest is cooled efficiently and uniformly to a necessary and minimum extent. Thus, it is possible to prevent an exhaust valve seat 51 and a mounting portion for the valve seat 51 from being thermally damaged, thereby maintaining their functions. Such a cooling effect also appears in the intake side.

If the plurality of regions A to D and f to i of the different lead loads in the partition wall 11 and the squish area 47 of the combustion chamber 17 are cooled to the necessary and minimum extent depending on the magnitudes of the heat loads, as described above and if the propagation of heat to a main body of the cylinder head through the partition wall 11 is suppressed by the heat-insulating layer 18, the combustion chamber 17 can be maintained at a high temperature to maintain the temperature of the exhaust gas at a high level.

In a second embodiment of the internal combustion engine 2 shown in FIGS. 4 to 10, provided within a cylinder head 10 are a partition wall 11 having a substantially conical shape as in the above-described embodiment with its apex turned to a side opposite from a cylinder block (not shown), and a peripheral wall 12 leading to a circular peripheral edge of the partition wall 11. A head 14 of a piston 13 lying at a top dead center is located on an inner periphery of the peripheral wall 12. A substantially conical combustion chamber 17 is provided on one side of the partition wall 11 and defined by cooperation of the partition wall 11 and a top surface 16 of the head of the piston 13 lying at the top dead center, and a heat-insulating layer 18 is provided on the other side of the partition wall 11.

As in the first embodiment, the following regions exist in the partition wall 11: an exhaust annular region A existing around an inlet 20 of an exhaust port 19; an intake annular region B existing around an outlet 22 of an intake port 21; an exhaust fan-shaped region C which exists between the inlet 20 and the outlet 22, extends in a divergent manner from a center portion of the partition wall 11 and is closer to the exhaust port 19, and an intake fan-shaped region D which exists between the inlet 20 and the outlet 22, extends in a diverging manner from the center portion of the partition wall 11 and is closer to the intake port 21.

In this case, the order of the magnitudes of the heat loads is such that the magnitude in the exhaust annular region A>the magnitude in the exhaust fan-shaped region C≧the magnitude in the intake fan-shaped region D≧the magnitude in the intake annular region B, unlike the first embodiment.

Cooling passages are provided in the regions A to D, respectively. The cooling passages are an exhaust curved passage a in the exhaust annular region A; an intake curved passage b in the intake annular region B; an exhaust fan-shaped passage c extending in a zigzag line in a plane intersecting a direction of thickness of the partition wall 11 in the exhaust fan-shaped region C; and an intake fan-shaped passage d likewise extending in a zigzag line in the intake fan-shaped region D. In the embodiment, water is used as a cooling medium.

The magnitudes of flow rates of the cooling water are set depending on the magnitudes of the heat loads, so that a flow rate in the exhaust curved passage a>a flow rate in the exhaust fan-shaped passage c≅a flow rate in the intake fan-shaped passage d≧a flow rate in the intake curved passage b. The adjustment of the flow rate of the cooling water is conducted by varying diameters of orifices 52 to 55 defining inlets of the passages a to d. Outlets of the passages a to d are collected into a single collection passage 56 defined in a reinforcing rib 41. The collection passage 56 communicates with a cooling passage 45 in the valve stem guide 44 for the exhaust valve, which communicates with an outlet (not shown).

Occupation rates of the exhaust and intake fan-shaped regions C and D of smaller heat loads in the partition wall 11 and an occupation rate of the exhaust annular region A of heat load larger than those of the regions C and D in the partition wall 11 are such that the former C, D is larger than the latter A. Therefore, sectional areas of the exhaust and intake fan-shaped passages c and d existing in the exhaust and intake fan-shaped regions C and D of the smaller heat loads and a sectional area of the exhaust curved passage a existing in the exhaust annular region A of the larger heat load are such that the former c, d is smaller than the latter a, and surface areas of the exhaust and intake fan-shaped passages c and d existing in the exhaust and intake fan-shaped regions C and D of the smaller heat loads and a surface area of the exhaust curved passage a existing in the exhaust annular region A of the larger heat load are such that the former c, d is larger than the latter a.

As clearly shown in FIGS. 5 to 8, the exhaust curved passage a, the intake curved passage b and the exhaust and intake fan-shaped passages c and d each extending in the zigzag line as well as a cylindrical cooling passage 35 existing in the peripheral wall 12 leading to the partition wall 11 for cooling a squish area 47 of the combustion chamber 17 are formed using a single core or a plurality of cores.

Figure 5:
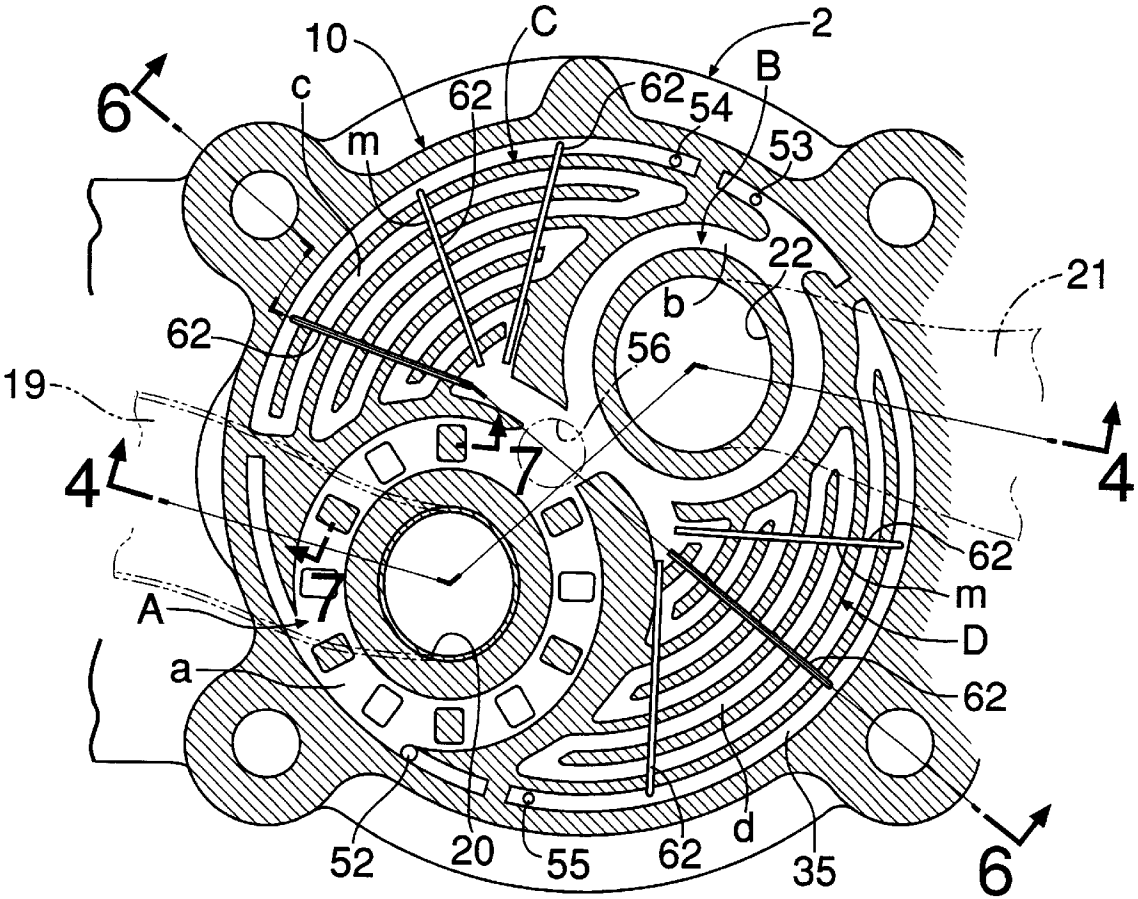
FIG. 5 is a sectional view taken along a line 5—5 in FIG. 4.
Figure 6:
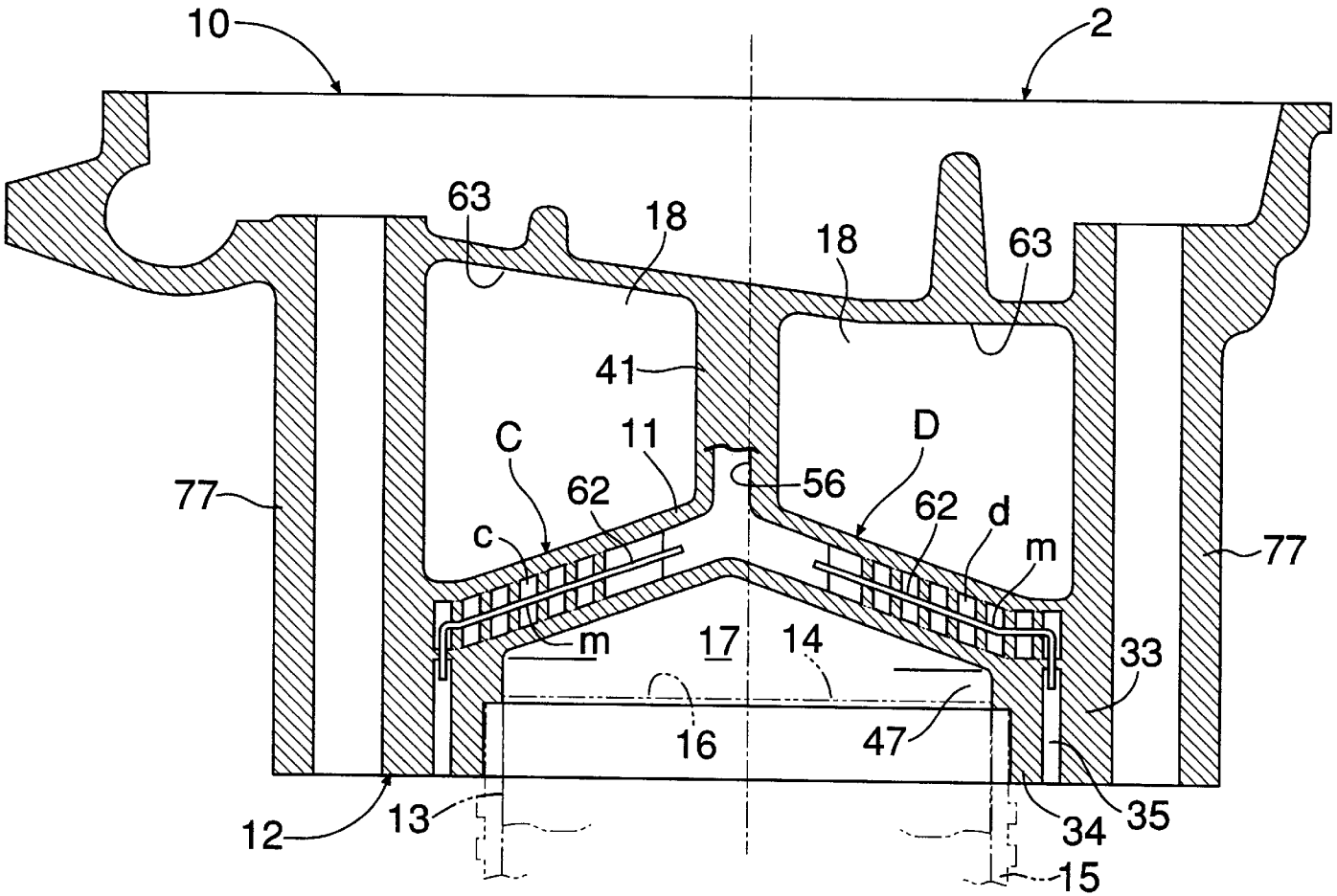
FIG. 6 is a sectional view taken along a line 6—6 in FIG. 5.
Figure 7:
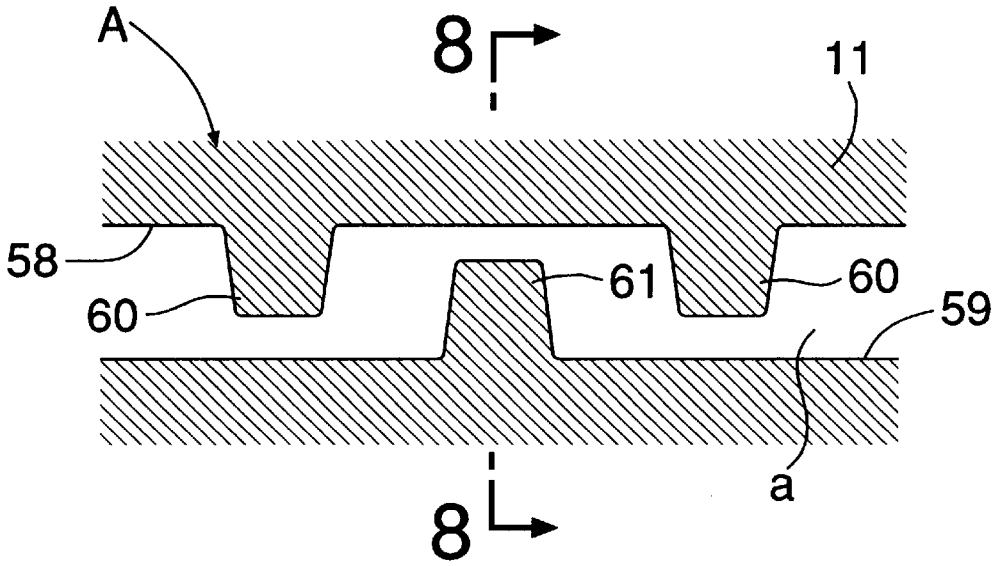
FIG. 7 is a sectional view taken along a line 7—7 in FIG. 5.
Figure 8:
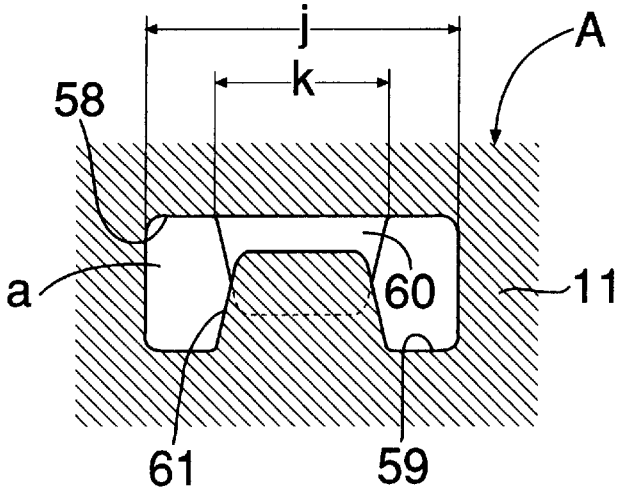
FIG. 8 is a sectional view taken along a line 8—8 in FIG. 7.

As shown in FIGS. 7 and 8, pluralities of protrusions 60 and 61 are formed on a ceiling wall 58 and a bottom wall 59 of the exhaust curved passage a at predetermined distances, respectively, so that the protrusions on the ceiling wall 58 and the protrusions on the bottom wall 59 are staggered from each other. The protrusions 60 and 61 each have a width k smaller than a width i of each of the ceiling and bottom walls 58 and 59. Thus, the cooling water flowing through the exhaust curved passage a flows in a zigzag line in a plane parallel to the direction of the thickness of the partition wall 11 and becomes a turbulent flow to efficiently cool the exhaust annular region A. As shown in FIGS. 5 and 6, in the formation of the cylinder head 10 by a casting process, a plurality of pins 62 are disposed in an piecing manner, for example, in a plurality of arcuate portions arranged concentrically on a zigzag-shaped section of a core to prevent the damage, misalignment and the like of the arcuate portions. A portion of each of the pins 62 on the side of a cylindrical section (corresponding to the cylindrical cooling passage 35) of the core is disposed so that it is pieced into the cylindrical section, whereby the positioning of the zigzag-shaped section and the cylindrical section is achieved.

If the cylinder head 10 is formed of an aluminum alloy and each of the pins 62 is formed of a stainless steel or the like, even if the core is removed after the casting, the pins 62 are left in the partition wall 11 and the peripheral wall 12, and a portion of each pin 62 is exposed to the insides of the exhaust and intake fan-shaped passages c and d. This exposed portion m functions as a resistor against the flow of the cooling water to promote the formation of a turbulent flow. This brings about an effect of improving the abatement of heat in the exhaust and intake fan-shaped regions C and D.

The heat-insulating layer 18 is formed by air existing in a cavity 63 defined in the cylinder head 10, but a heat-insulating material, e.g., a powdery heat-insulating material formed from particles having an nm size may be filled in the cavity 63.

Figure 4:
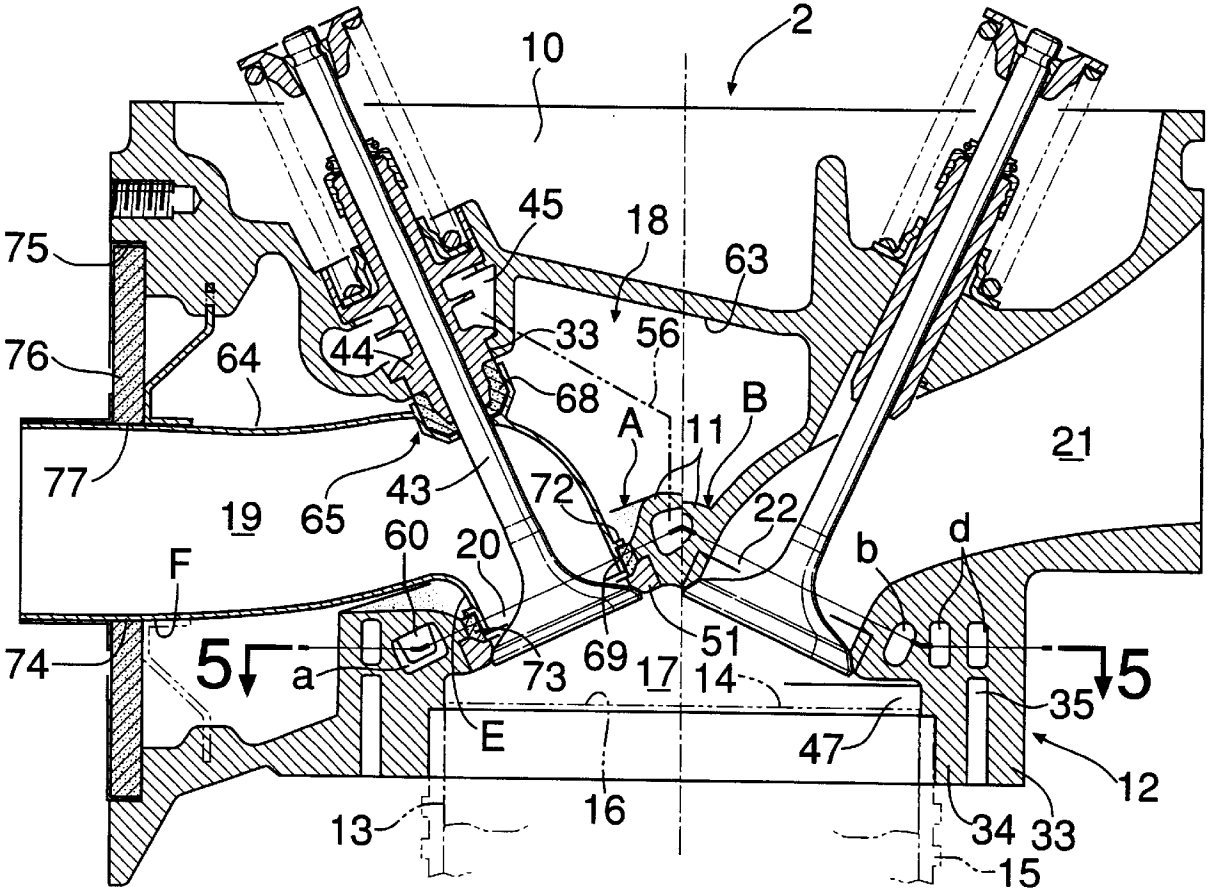
FIG. 4 is a vertical sectional front view showing a second example of a cylinder head, and corresponds to a sectional view taken along a line 4—4 in FIG. 5.
Figure 9:
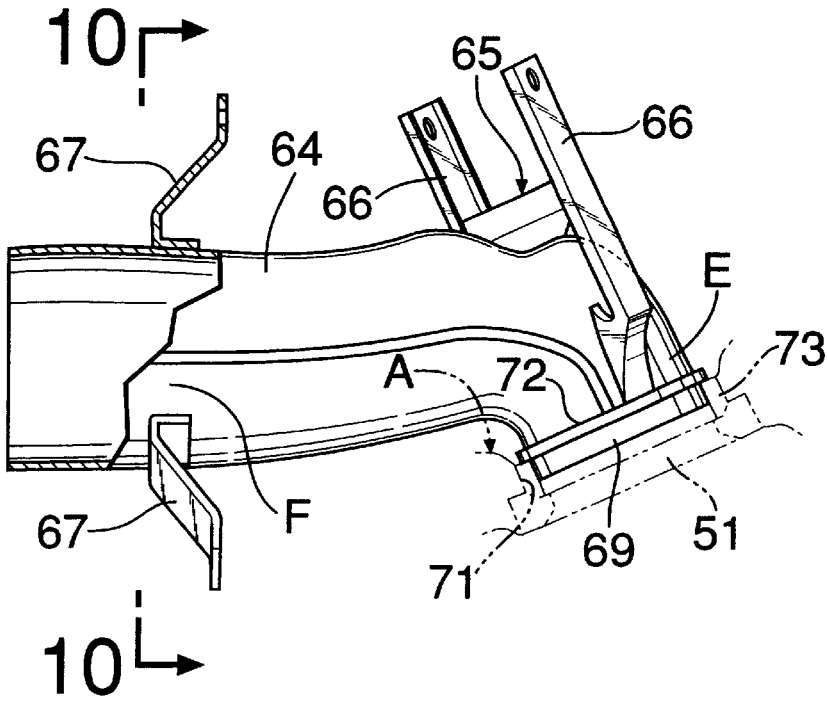
FIG. 9 is a perspective view of an exhaust port liner.
Figure 10:
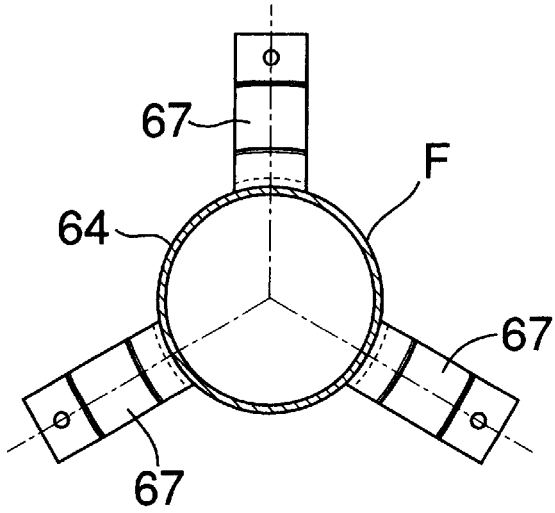
FIG. 10 is a cut end view taken along a line 10—10 in FIG. 9.

As shown in FIGS. 4, 9 and 10, the exhaust port 19 is defined by a cylindrical exhaust port liner 64 made of a stainless steel. The exhaust port liner 64 is disposed in the cavity 63 in the cylinder head 10 and supported partially at a plurality of points on the cylinder head 10. Thus, the heat-insulting layer 18 is provided around the exhaust port liner 64 and formed by air existing in the cavity 63.

Selected as the partially supported points on the exhaust port liner 64 are a site E existing on an outer peripheral surface of the exhaust port liner 64 on the side of an exhaust gas inlet in which an exhaust valve 43 is disposed, and a site F existing on the outer peripheral surface of the exhaust port liner 64 on the side of an exhaust gas outlet, as well as a cylindrical valve stem-insertion portion 65, as shown in FIGS. 4 and 9. More specifically, two stays 66 made of a stainless steel are disposed in an opposed relation at the site E existing on the outer peripheral surface on the side of the exhaust gas inlet, so that they sandwiches the valve stem-insertion portion 65 and so that they are substantially parallel to a valve stem axis n. Each of the stays 66 is welded at one end to the side E. The stays 66 may be integral with the exhaust port liner 64. Three stays 67 made of a stainless steel are disposed at distances of 120 degree in a circumferential direction at the side F existing on the outer peripheral surface on the side of the exhaust gas outlet, and each welded at one end to the side F. The other ends of the stays 66 and 67 are located in a cast-in in the cylinder head 10 in the course of forming the cylinder head 10 in a casting process. The cylindrical valve stem-insertion portion 65 is supported on the cylinder head 10 through a heat-insulating seal member 68 having a cushioning property and a valve stem guide 44. As shown in FIGS. 4 and 9, an inlet-defining portion 69 of the exhaust port liner 64 is loosely inserted into a bore 71 adjoining a valve seat 51, and an annular space between the valve seat 51 and a flange 72 of the exhaust port liner 64 existing in the vicinity of the inlet-defining portion 69 is filled with a heat-insulating annular seal member 73 having a cushioning property. Each of the seal members 68 and 73 is a molded product comprising an alumina fiber, a silica fiber and a binder and has a useful temperature of 1,100° C. or more and a heat transfer coefficient of 0.2 W/(m.K). An outlet-defining portion 74 of the exhaust port liner 64 is fitted into a bore 77 in an annular heat-insulating plate 76 which closes an opening 75 of the cavity 18. On the other hand, the intake port 21 is defined directly in the cylinder head 10.

Figure 11:
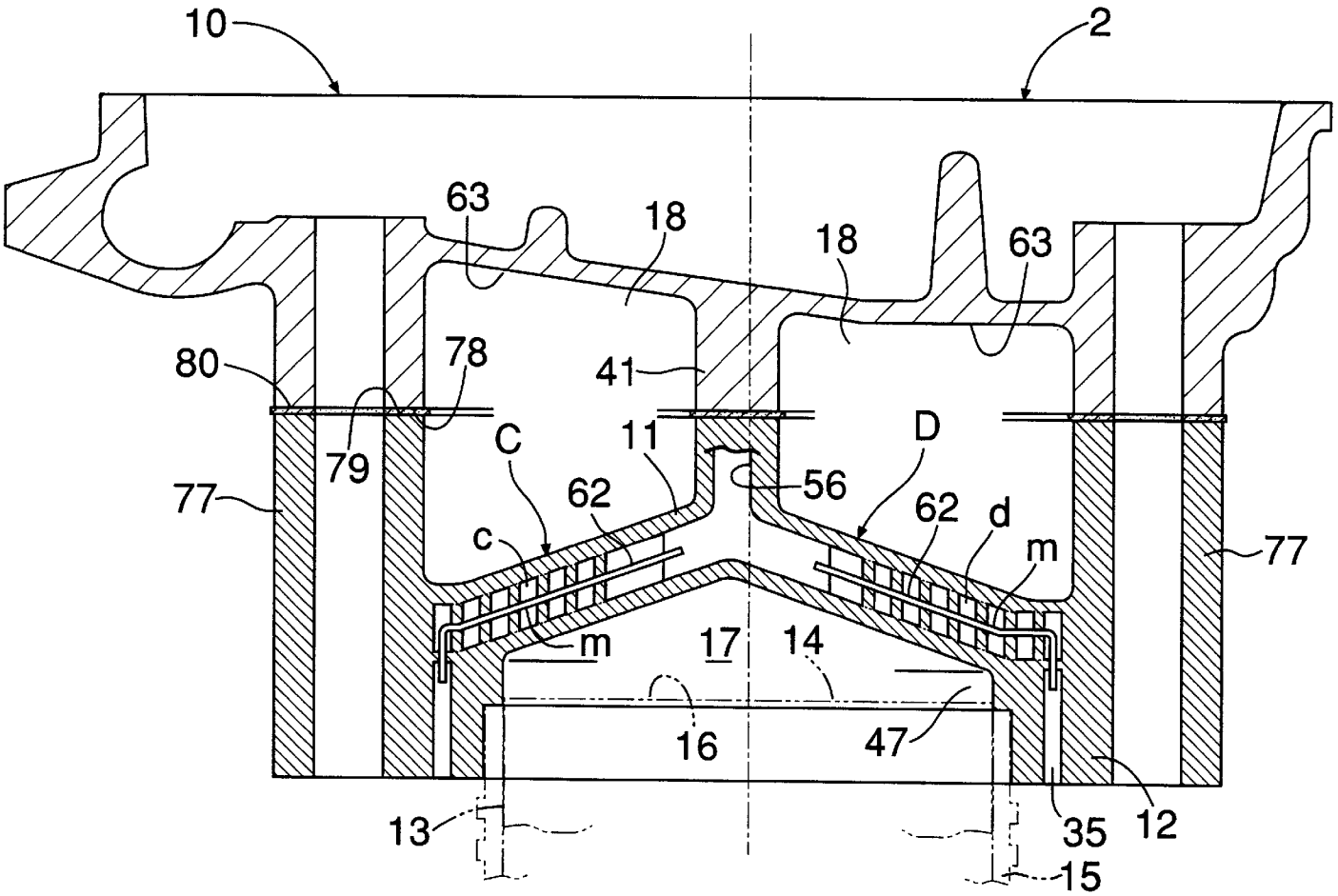
FIG. 11 is a vertical sectional side view showing a third example of a cylinder head, and corresponds to FIG. 6.

The cylinder head 10 shown in FIG. 11 is divided so that mating surfaces 78 and 79 exist on the reinforcing rib 41 having the collection passage 56 and on a plurality of bolt bore-defining portions 77 extending in parallel to the reinforcing rib 41 from the outer periphery of the peripheral wall 12, and a heat-insulating gasket 80 is clamped between the mating surfaces 78 and 79, so that the transfer of heat from the combustion chamber 17 is blocked by this dividing portion. In the second embodiment, of course, the flow rate in the annular cooling passage 35 for cooling the squish region 47 of the combustion chamber 17 may be varied likewise depending on the heat load.

In the wider intake and exhaust fan-shaped regions D and C of the smaller heat loads in the partition wall 11, the heat abatement can be enhanced by a synergistic effect provided by decreasing the sectional area of the cooling passage to permit the flowing of the cooling medium at a higher speed and by an enhancement in heat transfer coefficient attributable to an increase in passage surface area and an increase in Reynolds number. Thus, it is possible to sufficiently suppress the propagation of heat to a main body of the cylinder head, whereby the heat-insulting layer 18 may be eliminated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

a combustion chamber (17) provided in a cylinder head (10) on one side of a partition wall (11);

a heat-insulating space (18) provided in said cylinder head (10) on the other side of said partition wall (11) over an area covering at least the combustion chamber as viewed along a cylinder axis for suppressing propagation of heat to a main body of the cylinder head; and cooling passages (a to d) provided in a plurality of regions (A to D) provided with different heat loads in said partition wall (11), respectively, so that the flow rate of a cooling medium is decreased from said cooling passage (a) existing in the region (A) of the largest heat load to said cooling passage (d) existing in said region (D) of the smallest heat load.

2. The internal combustion engine according to claim 1, wherein a dividing section exists in a fan-shaped area on a mating surface of the inner wall to bisect the fan-shaped passage circumferentially, and a plurality of arcuate grooves are concentrically defined on opposite sides of the dividing section.

3. The internal combustion engine according to claim 1, wherein a least one of the cooling passages is zigzag shaped.

4. The internal combustion engine according to claim 1, the cylinder head further comprising:

a peripheral wall; and a reinforcing rib, the reinforcing rib extending above a central portion of the combustion chamber to an upper wall extending between the reinforcing rib and the peripheral wall, wherein the heat-insulating space is defined in the cylinder head by the partition wall, the reinforcing rib, the peripheral wall, and the upper wall.

5. The internal combustion engine according to claim 4, wherein the heat-insulating space is provided with a projecting section which overlaps at least a portion of a side of the combustion chamber.

6. The internal combustion engine according to claim 1, wherein an intake port and an exhaust port are provided with said area covering at least said combustion chamber and said heat-insulating space is interposed between said partition wall and said intake and exhaust ports.

7. An internal combustion engine according to claim 1, wherein the occupation rate of the region (C) of the smaller heat load in the partition wall (11) and the occupation rate of the region (A) of the heat load larger than that of such region in the partition wall (11) are such that the former is larger than the latter;

the sectional area of the cooling passage (c) existing in the region (C) of the smaller heat load and the sectional area of the cooling passage (a) existing in the region (A) of the heat load larger than that of such region (c) are such that the former is smaller than the latter; and the surface area of the cooling passage existing (c) in the region (C) of the smaller heat load and the surface area of the cooling passage (a) existing in the region (A) of the heat load larger than that of such region are such that the former is larger than the latter.

8. An internal combustion engine according to claim 1, wherein a cooling passage (35) for cooling a squish area (47) of said combustion chamber (17) defined by an outer peripheral portion of a head top surface (16) is provided in a peripheral wall (12) leading to said partition wall (11) and brought into sliding contact with a head (14) of a piston (13) lying at a top dead center, so that the flow rate of the cooling medium in said cooling passage (35) is decreased from a flow path section (f) existing in the vicinity of a site of the largest heat load in said squish area (47) to a flow path section (i) existing in the vicinity of a site of the smallest heat load in said squish area (47).

9. The internal combustion engine according to claim 8, wherein a cooling passage (35) for cooling a squish area (47) of said combustion chamber (17) defined by an outer peripheral portion of a head top surface (16) is provided in a peripheral wall (12) leading to said partition wall (11) and brought into sliding contact with a head (14) of a piston (13) lying at a top dead center, so that the flow rate of the cooling medium in said cooling passage (35) is decreased from a flow path section (f) existing in the vicinity of a site of the largest heat load in said squish area (47) to a flow path section (i) existing in the vicinity of a site of the smallest heat load in said squish area (47).

10. An internal combustion engine comprising:

a combustion chamber (17) provided in a cylinder head (10) on one side of a partition wall (11);

a heat-insulating layer (18) provided in said cylinder head (10) on the other side of said partition wall (11); and cooling passages (a to d) provided in a plurality of regions (A to D) provided with different heat loads in said partition wall (11), respectively, so that the flow rate of a cooling medium is decreased from said cooling passage (a) existing in the region (A) of the largest heat load to said cooling passage (d) existing in said region (D) of the smallest heat load;

wherein the occupation rate of the region (C) of the smaller heat load in the partition wall (11) and the occupation rate of the region (A) of the heat load larger than that of such region in the partition wall (11) are such that the former is larger than the latter;

the sectional area of the cooling passage (c) existing in the region (C) of the smaller heat load and the sectional area of the cooling passage (a) existing in the region (A) of the heat load larger than that of such region (c) are such that the former is smaller than the latter; and the surface area of the cooling passage existing (c) in the region (C) of the smaller heat load and the surface area of the cooling passage (a) existing in the region (A) of the heat load larger than that of such region are such that the former is larger than the latter.

11. The internal combustion engine according to claim 10, wherein a cooling passage (35) for cooling a squish area (47) of said combustion chamber (17) defined by an outer peripheral portion of a head top surface (16) is provided in a peripheral wall (12) leading to said partition wall (11) and brought into sliding contact with a head (14) of a piston (13) lying at a top dead center, so that the flow rate of the cooling medium in said cooling passage (35) is decreased from a flow path section (f) existing in the vicinity of a site of the largest heat load in said squish area (47) to a flow path section (i) existing in the vicinity of a site of the smallest heat load in said squish area (47).

12. An internal combustion engine comprising:

a combustion chamber (17) provided in a cylinder head (10) on one side of a partition wall (11);

a heat-insulating layer (18) provided in said cylinder head (10) on the other side of said partition wall (11 ); and cooling passages (a to d) provided in a plurality of regions (A to D) provided with different heat loads in said partition wall (11), respectively, so that the flow rate of a cooling medium is decreased from said cooling passage (a) existing in the region (A) of the largest heat load to said cooling passage (d) existing in said region (D) of the smallest heat load, wherein a cooling passage (35) for cooling a squish area (47) of said combustion chamber (17) defined by an outer peripheral portion of a head top surface (16) is provided in a peripheral wall (12) leading to said partition wall (11) and brought into sliding contact with a head (14) of a piston (13) lying at a top dead center, so that the flow rate of the cooling medium in said cooling passage (35) is decreased from a flow path section (f) existing in the vicinity of a site of the largest heat load in said squish area (47) to a flow path section (i) existing in the vicinity of a site of the smallest heat load in said squish area (47).

* * * * *